United States Patent [19]

Santiago

[11] Patent Number: 4,918,823

[45] Date of Patent: Apr. 24, 1990

[54] GUNSIGHT

[76] Inventor: Julio A. Santiago, 13713 Susan La., Burnsville, Minn. 55337

[21] Appl. No.: 214,726

[22] Filed: Jul. 1, 1988

Related U.S. Application Data

[63] Continuation-in-part of Ser. No. 145,030, Jan. 19, 1988.

[51] Int. Cl.[5] ..... F41G 1/00

[52] U.S. Cl. ..... 33/241; 33/243; 33/233

[58] Field of Search ..... 33/233, 241, 242, 243; 42/100, 103

[56] References Cited

U.S. PATENT DOCUMENTS

| | | | |
|---|---|---|---|
| 1,363,553 | 12/1920 | Barringer . | |
| 1,718,458 | 6/1929 | Hager et al. . | |
| 3,028,674 | 4/1962 | Luebkeman | 33/243 |
| 3,386,171 | 6/1968 | Kuebkeman | 33/233 |
| 3,698,091 | 10/1972 | Merrill . | |
| 3,698,092 | 10/1972 | Rosenhan | 33/241 |
| 3,984,917 | 10/1976 | Korzeniewski | 33/244 X |
| 4,663,878 | 5/1987 | Beretta | 42/100 |
| 4,679,344 | 7/1987 | Jolly . | |
| 4,713,889 | 12/1987 | Santiago . | |

FOREIGN PATENT DOCUMENTS

| | | |
|---|---|---|
| 665662 | 6/1939 | Fed. Rep. of Germany . |

*Primary Examiner*—Harry N. Haroian
*Attorney, Agent, or Firm*—Jacobson & Johnson

[57] ABSTRACT

A sighting device for mounting on the top of a weapon comprising a channel member having a pair of sidewalls extending upward, with the sidewalls having parallel topmost light reflective sighting surfaces to quickly guide the user's eye into initial alignment with a target and the reflective sighting surfaces and a sight post spaced between the sidewalls to enable a user to precisely aim a weapon attached to the channel sight.

6 Claims, 4 Drawing Sheets

GUNSIGHT

CROSS REFERENCE TO RELATED APPLICATIONS

This is a continuation-in-part of my copending U.S. patent application titled GUNSIGHT, Ser. No. 145,030, filed Jan. 19, 1988.

FIELD OF THE INVENTION

This invention relates to gunsights and, more particularly, to a gunsight that can be rapidly aimed with both eyes open thus eliminating the need for the user to close one eye and locate the gunsight and the target.

DESCRIPTION OF THE PRIOR ART

My U.S. Pat. No. 4,713,889 discloses an illuminated gunsight for mounting on a weapon to permit the user to aim and shoot in both daytime conditions and low-light conditions. The sighting device includes a U-shaped channel with a pair of fluorescent lines located along the bottom of the sighting channel. The fluorescent lines act as a quick reference to enable the user to quickly sight in on the target. In the daytime use of the gunsight shown in my patent, the user's eye is first drawn to the fluorescent lines followed by the user peering through the channel to locate the target.

My present invention also uses a U-shaped channel with sighting lines to enable the user to even more quickly aim a weapon. Briefly, the present invention utilizes the sighting surfaces on the topmost surfaces of the sights so that the eye does not have to search in the channel for the fluorescent sighting lines. That is, with the sight shown in my patent, if the weapon is not in initial alignment with the target the user only sees a portion of the fluorescent sighting strips. With my present invention the user immediately sees the location of the entire sighting surfaces even if the weapon is not in alignment with the target, since the sight lines are on top of the sighting channel. For example, if the user has to rotate the weapon to get the sights into initial alignment, the user can readily do so since the sighting surfaces are located on top of the sighting channel and thus readily visible to the user because the sighting surfaces are not obscured by the sidewalls of the gunsight.

The present invention further differs from the sighting device shown in my U.S. Pat. No. 4,713,889 in the manner of location of the gunsight. The gunsight shown in my patent mounts along the entire length of the barrel of a hand gun revolver whereas the present invention can be mounted on the portion of a semi-automatic pistol slide in front of the ejection port, yet still provide an accurate light. The present invention can also be adapted to revolvers and hand-held weapons.

BRIEF SUMMARY OF THE INVENTION

Briefly, the present invention comprises a gunsight having a pair of parallel light reflecting surfaces located at the topmost portion of the gunsight surface to enable the user to initially align the gunsight with a target while both eyes are open.

DESCRIPTION OF THE PREFERRED EMBODIMENT

Figure 1:
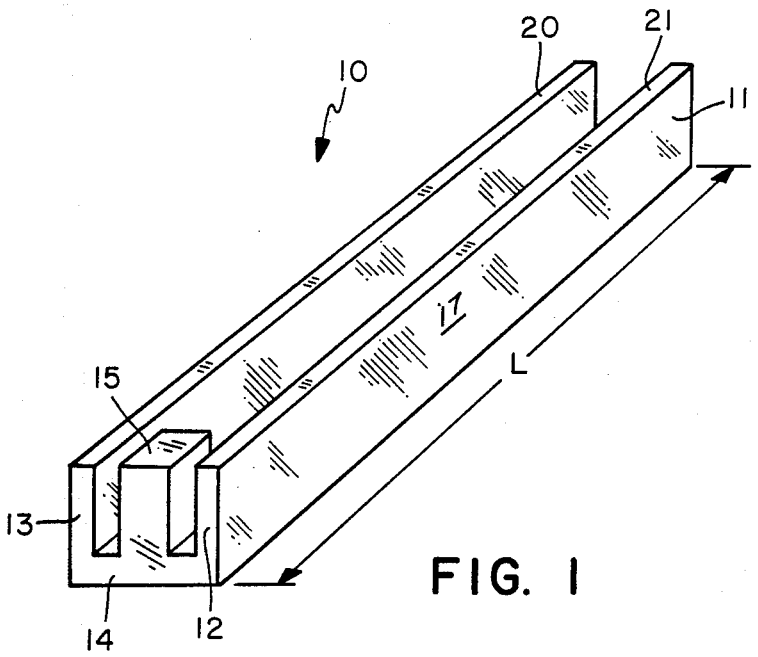
FIG. 1 is a perspective view of my sighting device for mounting on top of a weapon.

Referring to FIG. 1 reference numeral 10 identifies my improved channel sight for mounting on a pistol or handgun. My sight comprises a U-shaped channel 11 formed by a first rectangular shaped sidewall 12, a bottom section 14 and a second rectangular shaped sidewall 13. Located on top of sidewall 12 is a light reflecting surface 21 and located on top of sidewall 13 is a light reflecting surface 20 which is parallel to light reflecting surface 12. Light reflecting surfaces 12 and 13 are located on the topmost portion of sight 10 and provide prominent surfaces that contrast with the handgun to permit a user to quickly aim the weapon in daylight conditions without the user closing one eye. That is, the heavy light reflecting parallel lines 20 and 21 vividly contrast with the dark background of the handgun and almost immediately permit the user to line up the target with the parallel line sights on the weapon. Typically, the light reflecting surfaces may be a polished metal surface or a fluorescent surface that vividly contrasts with the top of the gun and the rest of the gunsight. Once the user has aligned the target with the parallel light reflecting lines, the predominant eye of the user automatically permits the user to align the sight post 15 with the target. Even if the user's nondominant eye is open during the sighting process, the sidewall of the channel sight shields the view for the nondominant eye, thus preventing the user from seeing a double image. Consequently, the user can aim and shoot a weapon without having to close one eye and without having to search for the sights on the front and back of the weapon since the sight lines on the top of the gunsight quickly direct the user's sight picture into the sighting channel.

Figure 2:
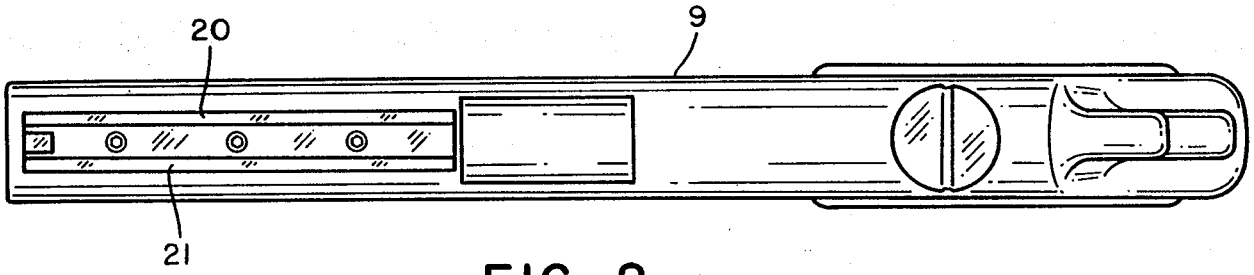
FIG. 2 is a top view of the sight of FIG. 1 mounted on the top of a hand gun having a light absorbing surface.

FIG. 2 illustrates the contrasting view presented to the shooter by the sights which are located on top of a weapon 9. Sight lines 20 and 21 vividly contrast with the weapon and are located on top of the channel rather than in the channel as shown in my U.S. Pat. No. 4,713,889. The location of the parallel sight lines on top of my channel sight rather than at the bottom of the channel has been found to permit the user to more quickly locate and align the target and the weapon since the sight lines are not in the shadow of the channel walls. Thus in the present sighting system the eyes are drawn to the reflective and highly visible sight lines located on top of the channel since there are no obstructions to distract the eyes or to obscure the target. The eyes can then be drawn into the bottom of my sighting channel whereas in my prior sight system with the sight lines located in the channel, the eyes are drawn into the bottom of the channel and then aligned around the sight post before a user can properly align the sights with the target. Since sight lines located in the bottom of the channel may be partially obscured by the sidewalls of the channels, the user may not be able to quickly align the sights with the target.

The present invention also permits the user to use the sight lines on the top of the channel as the sole means of aligning the sights with the target if the user has to shoot quickly and at close range.

Figure 3:
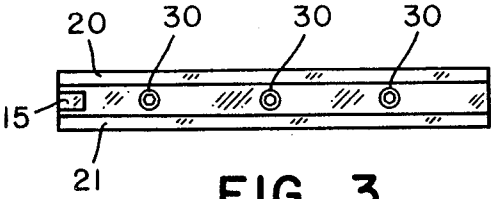
FIG. 3 is a top view of my sighting device illustrating the sight post and the means for mounting the sight to a weapon.

A reference to FIG. 3 illustrates a top view of channel sight 10 which illustrates that in a top view the front sight post 15 is visible but does not have a top reflecting surface as do surfaces 20 and 21 which form the sight lines. Sight line 20 and sight line 21 are identical in size and length and in their reflective appearance so as to not draw the user's eye to one sight line or the other sight lines. Sight lines 20 and 21 are approximately 2½ inches long and approximately slightly less than an ⅛ inch wide. Sight lines 20 and 21 are shown spaced apart approximately ¼ inches to provide highly visible surfaces to permit the user to quickly zero in on the target once the sight lines are located. FIG. 3 also illustrates the openings 30 which permit one to mount sight 30 on top of a weapon.

Figure 4:
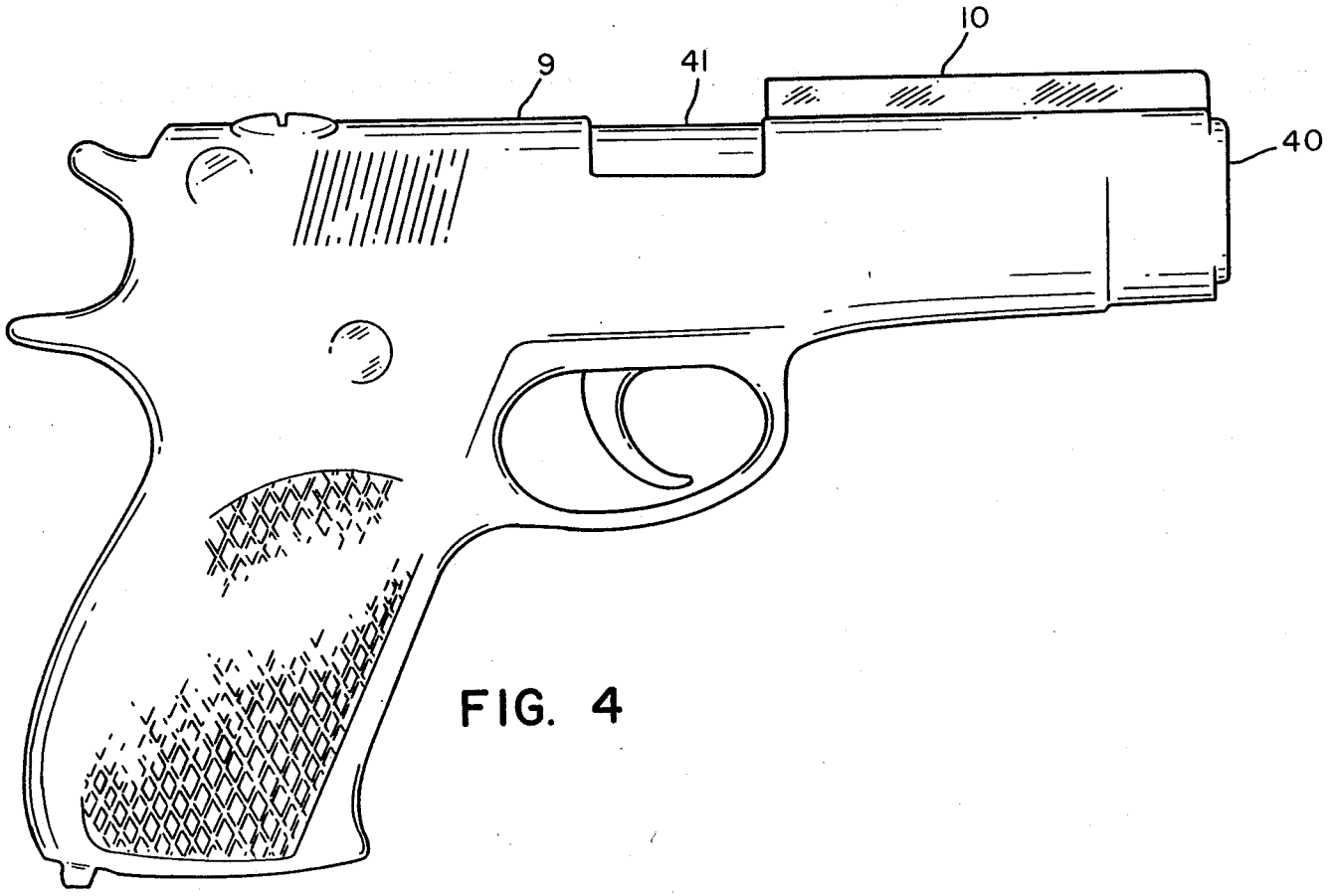
FIG. 4 is a side view of a hand gun having my channel sighting device located in front of the ejection port.

FIG. 4 shows a side view of an automatic hand gun with my channel sight located on the front portion of the barrel 40. A further feature of the present invention is that the sights are not required to be spaced at the front and rear of the handgun as with conventional post sights. FIG. 4 illustrates that my channel sight is only located on the portion of the barrel in front of the ejection port 41 thus permitting my channel sight to be used with automatic handguns with side ejection ports for spent casings.

Figure 5:
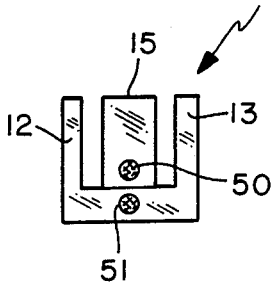
FIG. 5 is a rear view of the sighting device illustrating the use of luminescent sights to permit aiming and shooting under low-light conditions.

A further feature of the present invention is that my channel sight can be combined with illuminated sources to provide for night time shooting. FIG. 5 shows a rear view of my channel sight 10 with a radioluminescent dot sight 50 located on the back of front sight post 15 and a secod radioluminescent dot sight 51 located on back end of channel sight 10. The radioluminescent sights are described in my U.S. Pat. No. 3,641,676. In my preferred embodiment I use a luminescent gas such as trittium or promethium in the dot sights to provide the necessary illumination for night time shooting. Although radioluminescent sights are preferred, other light sources could be used for providing illuminated sights for night time shooting. The circular or luminescent dot sights 50 and 51 have a diameter of approximately 0.080 inches and are positioned above and below the bottom of the channel. To properly align the illuminated sights with the target, the user moves sight 10 until the dot sights 50 and 51 appear as a figure eight. Thus the present invention provides for rapid two-eye aiming and shooting under daytime conditions and if used with illuminated sight posts, also permits aiming and shooting under night time or low light conditions.

Figure 6:
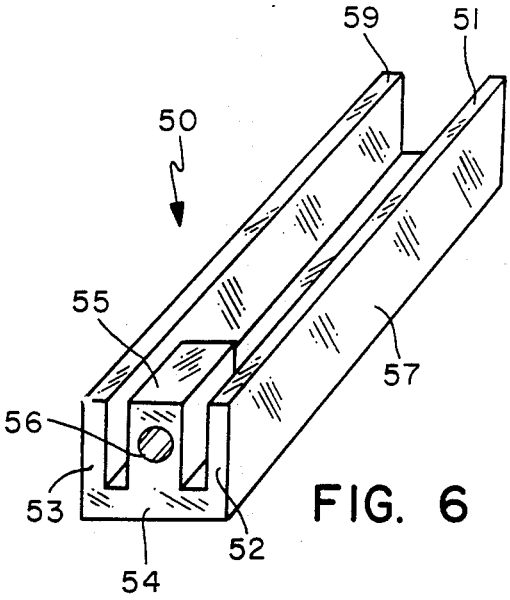
FIG. 6 is a perspective view of an alternate embodiment of my sighting device for mounting on top of a weapon.
Figure 7:
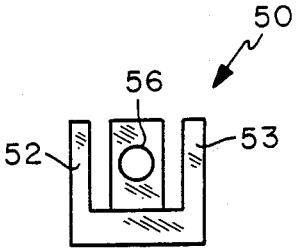
FIG. 7 is a rear view of the sighting device of FIG. 6 illustrating the use of an open hole through the front post.

Referring to FIGS. 6 and 7, reference numeral 50, identifies an alternate embodiment of my improved channel sight for mounting on a weapon for daytime and low level light or when the target is illuminated by artificial light. My sight comprises a U-shaped channel 50 formed by a first rectangular shaped sidewall 52, a bottom section 54 and a second rectangular shaped sidewall 53. Located on top of sidewall 52 is a light reflecting surface 51 and located on top of sidewall 53 is a light reflecting surface 59 which is parallel to light reflecting surface 53. Light reflecting surfaces 52 and 53 are located on the topmost portion of sight 50 and identical to the embodiment of FIG. 1 to provide prominent surfaces that contrast with the handgun to permit a user to quickly aim the weapon in daylight conditions without the user closing one eye. The embodiment of FIGS. 6 and 7 differ from the embodiment of FIG. 1 in that I have provided an opening 56 that extends through the front post 55. I have discovered that in low light conditions the use of a hole in the front sight provides background illumination to assist the shooter in lining the weapon with the target. The hole 56 is particularly useful when aiming a weapon at an illuminated object since light appears through opening 56 in the sight post, indicating that the user is on target. It should be pointed out that the opening is sufficiently small 0.086" in diameter so as not to provide a sight picture of an object but to merely display the lumination of the object the weapon is aimed at.

Figure 8:
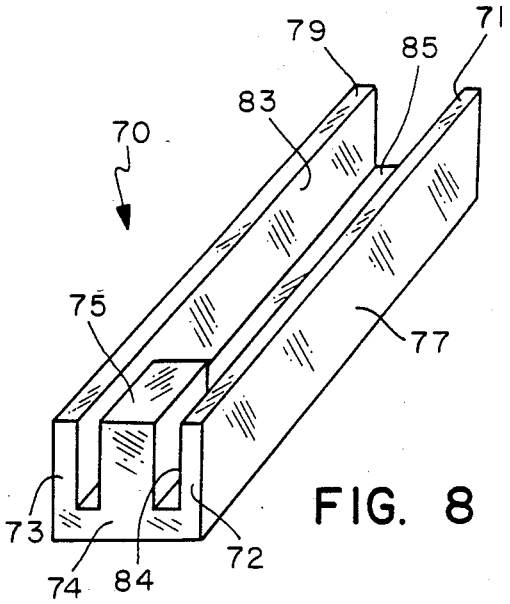
FIG. 8 is a perspective view of a further alternate embodiment of my sighting device for mounting on top of a weapon.
Figure 9:
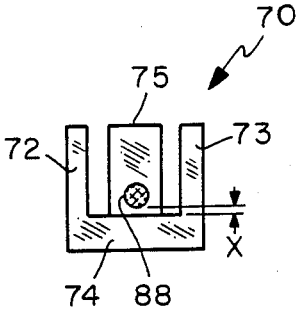
FIG. 9 is a rear view of the sighting device of FIG. 8 illustrating the use of a luminous sight with reflective sight channels.

Referring to FIGS. 7 and 8 reference numeral 70 identifies my improved channel sight for mounting on a weapon. My sight comprises a U-shaped channel 70 formed by a first rectangular shaped sidewall 72, a bottom section 74 and a second rectangular shaped sidewall 73. Located on top of sidewall 72 is a light reflecting surface 71 and located on top of sidewall 73 is a light reflecting surface 79 which is parallel to light reflecting surface 72. Light reflecting surfaces 12 and 13 are located on the topmost portion of sight 10 and provide prominent surfaces that contrast with the handgun to permit a user to quickly aim the weapon in daylight conditions without the user closing one eye. Located on the inside of sidewall 73 is a light reflecting surface 83 and similarly located on the inside of sidewall 72 is light reflecting surface 84. Similarly located on the bottom of sight 70 is a light reflecting surface 85. Typically, the light reflecting surfaces may be a polished metal surface. I have discovered that the use of interior reflective surfaces 83, 84, and 85 on the sight of FIG. 8 and FIG. 9 provides additional enhancement in aiming the weapon in nighttime and low light conditions. That is, if the interior surfaces are polished to reflect light, and the user immediately sees the reflection of the luminescent dot 88 on the sidewalls or the bottom of the channel the user knows the sight is out of line. When the luminescent dot does not reflect off the sides or bottom of the sight back to the user, the user knows that the weapon is aimed correctly. Luminescent dot 88 mounts a small distance from the bottom of channel 85, typically 0.01 inches. If the reflection is from the insides 83 or 84 the user knows the windage aim is incorrect. If the reflection is from the bottom of the channel 85 the user knows the elvation aim is incorrect. When the single dot appears with the target and without reflection the the weapon is properly aimed. The length of my channel sight is determined by the desired accuracy of the sight. That is, with a longer sight channel one can obtain greater shooting accuracy than with shorter sight channels. In most applications a sight length of approximately 4 inches provides a preferred accuracy.

Figure 10:
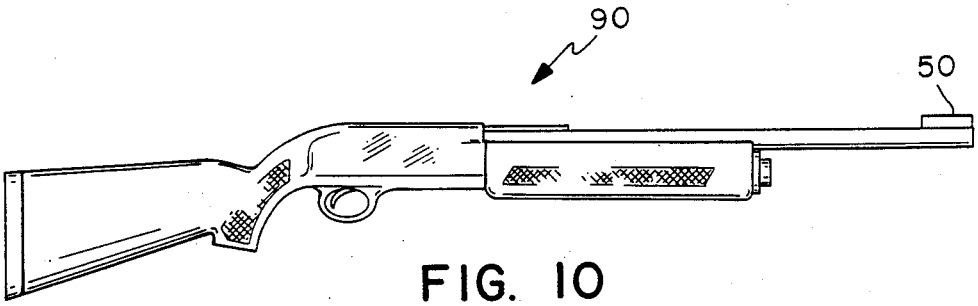
FIG. 10 is a side view of a sighting device mounted on a shotgun.

FIG. 10 shows my sight 50 mounted by a support 91 to a shotgun 90.

I claim:

1. A sighting device for mounting on the top of a weapon comprising:

a channel member having a first sidewall extending upward;

a second sidewall extending upward from said channel member;

a sight post located between said first sidewall and said second sidewall wherein said sight post has an illuminated area to provide an illuminated sight and wherein said first sidewall has an interior light reflecting surface to reflect the light from said illuminated sight back to the user if the sight is not correctly aimed at an object and said second sidewall has an interior light reflecting surface to reflect the light from said illuminated sight back to the user if the sight is not correctly aimed at an object.

2. A sighting device for mounting on the top of a weapon comprising:

a channel member having a first sidewall extending upward, said first sidewall having a first topmost light reflective sighting surface thereon;

said channel member having a second sidewall extending upward, said second sidewall having a second topmost light reflective sighting surface thereon, said first light reflective sighting surface parallel to said second light reflective sighting surface to quickly guide the users eye into initial alignment with a target and said first topmost light reflective sighting surface and said second topmost light reflective sighting surfaces;

a sight post spaced between said first sidewall and said second sidewall, said sight post having an opening therethrough to provide illumination of the object sighted through the opening in said sight post, said sight post and said sidewalls operable to enable a user to precisely aim a weapon attached to said sighting device.

3. The sighting device of claim 2 wherein the opening is less than 0.100 inches in diameter.

4. The sighting device of claim 1 including a shotgun for holding said sighting device at the end of said shotgun.

5. The sighting device of claim 1 wherein said sighting device has a bottom reflective surface thereon for reflecting the light from an illuminated light source back to the user if the elevation aim is incorrect and when no reflection is present the user knows that both the windage and elvation sightings are correct.

6. A sighting device for mounting on the top of a weapon to permit a user to aim and shoot a weapon with both eyes open comprising:

a channel member, said channel member having a first sidewall extending upward, said channel member having a second sidewall extending upward, and a sight post located between said first sidewall and said second sidewall, said sight post having an opening therethrough to permit a user to sight an object through said opening in said sight post, said first sidewall and said second sidewall forming a sight channel and cooperating with said sight post located there between to enable a user to precisely aim a weapon attached to said channel member by viewing along said channel member and through and around said sight post.

* * * * *